United States Patent [19]

Mackay et al.

[11] Patent Number: 4,915,830

[45] Date of Patent: Apr. 10, 1990

[54] PULP WASH PRESS

[75] Inventors: William D. Mackay, Montoursville; William L. Bohn, Williamsport, both of Pa.

[73] Assignee: Sprout-Bauer, Inc., Muncy, Pa.

[21] Appl. No.: 234,430

[22] Filed: Aug. 19, 1988

[51] Int. Cl.[4] ..... D21C 9/00

[52] U.S. Cl. ..... 210/209; 210/414; 210/415; 162/60; 162/38; 162/18; 100/117; 100/75

[58] Field of Search ..... 210/413, 414, 415, 209; 162/18, 56, 380, 60; 100/117, 74, 75, 145, 73; 127/7, 6, 5

[56] References Cited

U.S. PATENT DOCUMENTS

| | | | |
|---|---|---|---|
| 808,193 | 12/1905 | Bussells | 100/74 |
| 2,355,091 | 8/1944 | McDonald | 162/56 |
| 2,975,096 | 3/1961 | Ginaven et al. | 162/18 |
| 3,004,876 | 10/1961 | Zies . | |
| 4,838,995 | 6/1989 | Klauser | 162/56 |

FOREIGN PATENT DOCUMENTS

| | | | |
|---|---|---|---|
| 1101126 | 3/1961 | Fed. Rep. of Germany | 162/18 |

*Primary Examiner*—W. Gary Jones
*Assistant Examiner*—Matthew O. Savage
*Attorney, Agent, or Firm*—Chilton, Alix & Van Kirk

[57] ABSTRACT

An elongated, imperforate housing (2) has a slurry inlet port (5) at one end and a pulp discharge port (6) at the other end. A pressing section (**2*b*) within the housing is in direct fluid communication with the inlet port, and extracts liquid from the slurry by passing the slurry through a first compression restriction (108) to produce a pressed pulp. An annular washing section (2*c*) within the housing is positioned immediately downstream of, and in direct fluid communication with, the first compression restriction. The washing section has radially inner (109) and outer (14) cylindrical walls defining an annular washing chamber (110) for decompressing, diluting, and washing the pressed pulp. The washing is accomplished by injecting a washing liquid into the washing chamber through the inner wall, and simultaneously through the outer wall while the mixture is agitated. A repressing section (2*d*) within the housing is in direct fluid communication with the washing section, for receiving the conveyed mixture. The repressing section extracts the washing liquid from the mixture by passing the mixture through a second compression restriction (115) to produce a repressed pulp, which is then discharged through the discharge port. In a preferred embodiment, an additional, final pressing section (2*e*) is located between the repressing section and the discharge port, the final pressing section having a perforated, substantially cylindrical inner wall (116) formed in the screw shaft (3) and a deflection ring (49**) defining an outer wall spaced from the inner wall.

15 Claims, 6 Drawing Sheets

PULP WASH PRESS

BACKGROUND OF THE INVENTION

The present invention is directed to pulp processing, and more particularly, to apparatus and method for the displacement washing and pressing of pulp.

In the processing of wood chips to pulp, the chips are placed in a digester, which is a large vessel containing a solution referred to as "cooking liquor". The pulp and cooking liquor are then heated under pressure in order to remove the resins and to dissolve the lignin which holds together the desired cellulose fibers in the wood. The pulp, as it is discharged from the digester, contains a high proportion by weight of the cooking liquor. The liquor must be removed from the pulp before the pulp can be used in the manufacture of paper.

A conventional technique for removing liquor from pulp is to pass the pulp slurry through a screw press extractor, wherein the liquor is removed, or "expressed", from the slurry and, to a significant extent, the pulp fibers. Thereafter, the compressed pulp is conveyed to another piece of equipment, wherein it is mixed with water or other chemically active liquid, which loosens residual liquor or other undesirable components of the compressed pulp, so that they may be washed away. The washed pulp is then conveyed to a second screw press or the like, where the wash liquid is removed and the repressed pulp conveyed for further processing.

U.S. Pat. No. 3,256,808, "Screw Press Extractor" illustrates some common features of this type of screw press extractor, including a pressure screw which rotates within a cylindrical housing, the slurry thus being forced to pass through a narrowing restriction between the screw and the housing, such that the extracted liquid is removed from the housing through a housing screen.

U.S. Pat. Nos. 4,088,528 and 4,214,947, illustrate a pressure screw grinder and digester, respectively, wherein grinding and/or delignification is achieved by passing the raw material between interpenetrating helicoidal surfaces driven synchronously in rotation inside a casing. A braking zone is provided in which the pitch of the screw surfaces is reversed, thereby effectively forming a restriction. In these patents, the differences in pitch in part define different zones, where different chemical and/or mechanical processes are carried out. In one embodiment, the cellulosic material in the form of chips, it is passed in succession through a first braking zone which causes a first compression of the material, a subsequent zone where the material is brought into contact with a reagent, and another braking zone which causes a second compression. The first compression stage causes the expulsion, along the screw axis, of water present in the material and each subsequent compression causes the expulsion of any spent reagent and of residual liquors in the material.

In U.S. Pat. Nos. 3,533,510 and 3,911,809, a screw press dewatering apparatus is shown wherein a number of flaps are provided at the downstream end of the device immediately upstream of the discharge port, such that the back pressure can be adjusted at different annular positions around the last restrictor, thus providing a more uniform output of dewatered material.

U.S. Pat. No. 3,067,672 discloses a screw press apparatus and method wherein a washing and mixing station is positioned upstream of the compression and extraction section, these sections having different screws, oriented on different axes.

SUMMARY OF THE INVENTION

It is an object of the present invention to improve the washing efficiencies associated with pulp processing installations.

It is a further object to improve the chemical usage in such pulp processing installation, by mixing the chemicals with the pulp when the pulp is at a higher consistency than that typically found in known systems.

It is a further object to reduce the floor space required to implement such a process, and to reduce the cost.

These objects are accomplished by a method and apparatus in which an elongated, imperforate housing has a slurry inlet port at one end and a pulp discharge port at the other end. A pressing section within the housing is in direct fluid communication with the inlet port, and includes first means for extracting liquid from the slurry by passing the slurry through a first compression restriction to produce a pressed pulp. An annular washing section within the housing is positioned immediately downstream of, and in direct fluid communication with, the first compression restriction. The washing section has radially inner and outer cylindrical walls defining an annular washing chamber for decompressing, diluting, and washing the pressed pulp. The washing is accomplished by injecting a washing liquid into the washing chamber through the inner wall, and simultaneously through the outer wall while the mixture is agitated by means projecting from at least one of the walls into the mixing chamber. A repressing section within the housing is in direct fluid communication with the washing section, for receiving the conveyed mixture. The repressing section includes second means for extracting the washing liquid from the mixture by passing the mixture through a second compression restriction to produce a repressed pulp, which is then discharged through the discharge port.

In a preferred embodiment, an additional, final pressing section is located between the repressing section and the discharge port, the final pressing section having a perforated, substantially cylindrical inner wall formed in the screw shaft and a tapered compression ring defining an outer wall spaced from the inner wall.

In the method embodiment of the invention, low consistency pulp slurry is pumped into the press through an inlet nozzle. A decreasing volume screw conveys pulp through the first section of the press, where the pulp is compressed and the water is driven out through a drilled screen in the housing. Pulp is then conveyed by the screw to the mixing section, where it expands into an annular zone of increased volume and is sprayed with wash water and/or chemical. The water and/or chemical is injected from the inside of the screw and from an annular wash jacket. The wash liquid injected through the screw enters the screw through a rotary joint opposite the driven end, and is channeled to the wash section by a pipe coaxial with the screw. Radial holes allow wash liquid to flow into the mixing section. Wash liquid injected from the outside the screw, is pumped to a pressurized jacket having radial holes which allow wash water to flow into the mix section. Square pegs between interrupted flights on the screw in the mix section break up lumps and ensure uniform mixing. Low consistency, washed pulp enters the second compression section where it s repressed by the decreasing volume screw to a high consistency before being discharged from the press. A vertical divider separates the pressate from the two compression sections, allowing counter-current washing or separate chemical recovery. In the preferred embodiment which includes the final pressing section, a third pressate flow from the center of the screw allows this finally pressed fiber and pressate to be recovered separately from the pressate from the two compression sections.

The invention provides several significant advantages. The combination of two presses and a mixer in one unit, with a single screw and one inlet and one outlet port, reduces installation cost and the required space. The mixing section provides uniform mixing prior to recompression, resulting in more efficient washing. The screen supports prevent mixing of pressate, thereby improving chemical usage and recovery. The pressurized jacket provides for injection of water and a chemical from outside of the screw, without contaminating the pressate.

BRIEF DESCRIPTION OF THE DRAWINGS

These and other objects and advantages of the invention will be described below in connection with the preferred embodiment of the invention and with reference to the accompanying drawings, in which.

DESCRIPTION OF THE PREFERRED EMBODIMENT

Figure 1:
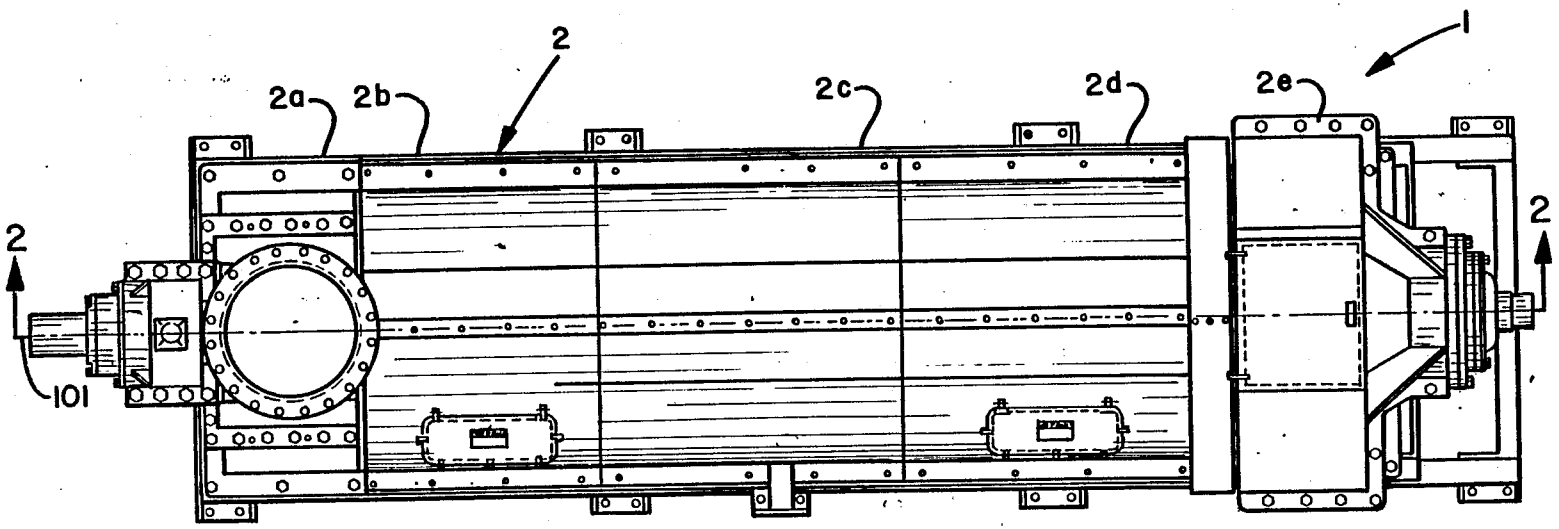
FIG. 1 is a plan view of the washing press in accordance with the invention.
Figure 2:
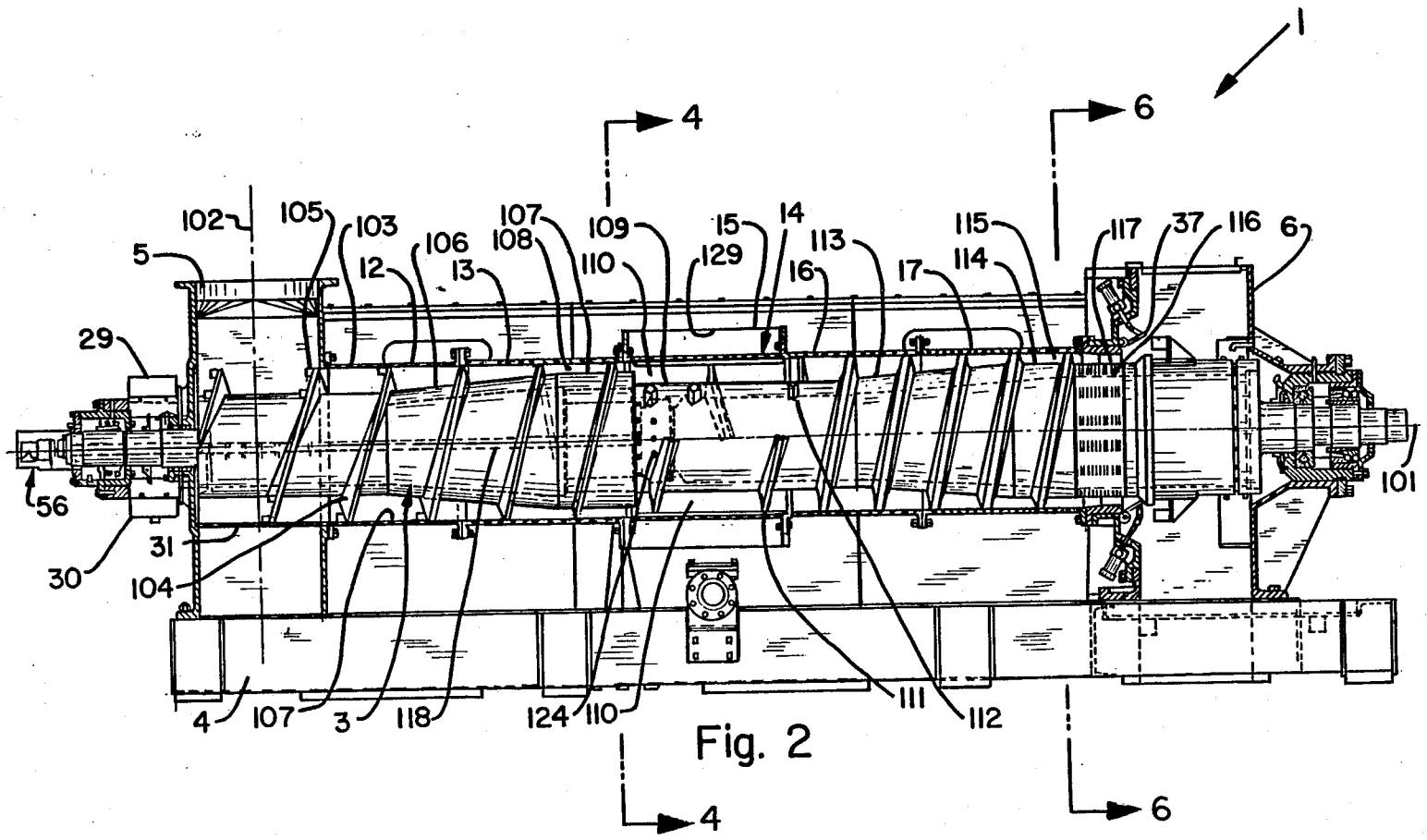
FIG. 2 is a side view, taken along section line 2—2 of FIG. 1.

FIGS. 1 and 2 show a displacement type of pulp wash press 1 which includes a housing 2 that in part defines an inlet section 2*a*, a pressing section 2*b*, a washing section 2*c*, a repressing section 2*d*, and a discharge section 2*e*. A pressure screw 3 is mounted in the housing 2 and defines a longitudinal, rotation axis 101. The housing 2 is mounted on a base 4 which in turn is typically bolted to the floor or other foundation of a pulp processing installation or plant.

The inlet section 2*a* has an inlet 5 which is preferably vertically oriented along inlet axis 102 which is, in turn, connected to a source of pulp slurry (not shown). The pulp slurry enters the inlet 5 and accumulates at the upstream, inlet end 103 of feed screw 3. This portion of the feed screw extends from the inlet section 2*a* into the pressing section 2*b*, and has a plurality of substantially helical screw flights 104 which may preferably have screen wipers 105, projecting in the upstream direction. The screen wipers 105 generate turbulence as they pass over the inlet screen 31. This prevents fiber build up on the screen, increasing drainage through the screen. The wipers also pull stock into the screw, improving filling of the screw.

In general, the pressure screw 3 has a varying diameter within a substantially cylindrical housing bore such that the slurry experiences a sequence of compression and expansion as it is conveyed by the screw 3 from the inlet section 2*a* to the discharge section 2*e*. The housing bore is preferably designed in part by a plurality of cylindrical screen sections connected end-to-end by, for example, flanges.

Within the pressing section 2*b*, the screw diameter tapers outwardly as shown at 106 and the screw flights 104 may differ from that associated with screw portion 103. The pressure screw 3 has a substantially cylindrical outer section 107 in the vicinity of the transition from the pressing section 2*b* to the washing section 2*c*, and thereby defines a first restriction annulus 108. During the conveyance of the slurry through the inlet sections 2*a* and pressing section 2*b*, the process liquor is extracted through inlet screen 31 and initial compression screen 13. A predraining screen 12 may also be provided between the inlet housing screen 31 and the compression screen 13. The liquor extracted through screens 12 and 13 is collected in the base 4 and drained through a flanged connection in the bottom of the base.

In the washing section 2*c*, the screw 3 is substantially cylindrical, with an outer diameter less than that of the screw portion 107, as indicated at 109, thereby providing an expansion and wash volume 110 for the pressed pulp. This expansion enables the pulp to absorb the wash or other chemical fluid that is injected into the mixing volume 2*c*, in a manner to be described more fully below. Through the washing section 110, the screw diameter 109 has interrupted screw flights 111, and mixing pegs 112, preferably square, projecting from the screw diameter in the spaces between the interrupted screw flights.

The mixture of washed pulp, extracted liquid, and washing fluid is then conveyed from the washing chamber 110 longitudinally into the repressing section 2*d*, where the diameter 113 of the pressure screw tapers outwardly in a downstream direction, similar to screw portion 106, and leads to a substantially cylindrical portion 114 where the restricted annulus 115 presses the washing liquid from the mixture. A pressing screen 16 spans the portion of the mixing section and a portion of the repressing section, and a compression screen 17 extends axially around the screw from approximately the center of the tapered diameter 113 to the restriction annulus 114. The liquor extracted through screens 16 and 17 is collected in another section of the base 4 and drained through a different flanged connection in the bottom of the base.

In a preferred embodiment of the invention, the discharge portion 2*e* includes a final pressing screen 116 formed on the circumference of the screw, which extracts at least some of the residual wash fluid in the pressed pulp as the pulp passes through annulus 117. A plurality of annularly-disposed discharge fingers 37 are under a threshold bias which acts to generate a back pressure in the annulus 117, thereby assisting the fluid extraction through screen 116. Upon overcoming the bias, the pulp passes into the discharge port 6 where it may be extracted for further processing in the manufacture of paper.

The arrangement of the pressing section 2*b* in fluid communication with the washing section 2*c* which is, in turn, in fluid communication with a second pressing or repressing, section 2*d*, all annularly disposed about the same pressure screw 3, achieves significant advantages relative to known equipment, in terms of efficiency and economy. The mixing in wash chamber 110, is preferably accomplished by discharge of washing fluid radially inwardly from wash jacket 15, and radially outwardly through wash screen 14 through holes 124 on screw 3. The source of fluid for the radially outward discharge, is a pipe or channel 118 extending along the screw axis 101 from a rotary fluid joint 56, which is external to the housing 2, to the washing section 2*c*. The washing section jacket 15 is pressurized and is isolated axially in the upstream and downstream directions, from the pressing and repressing sections 2*b* and 2*d*.

Figure 3:
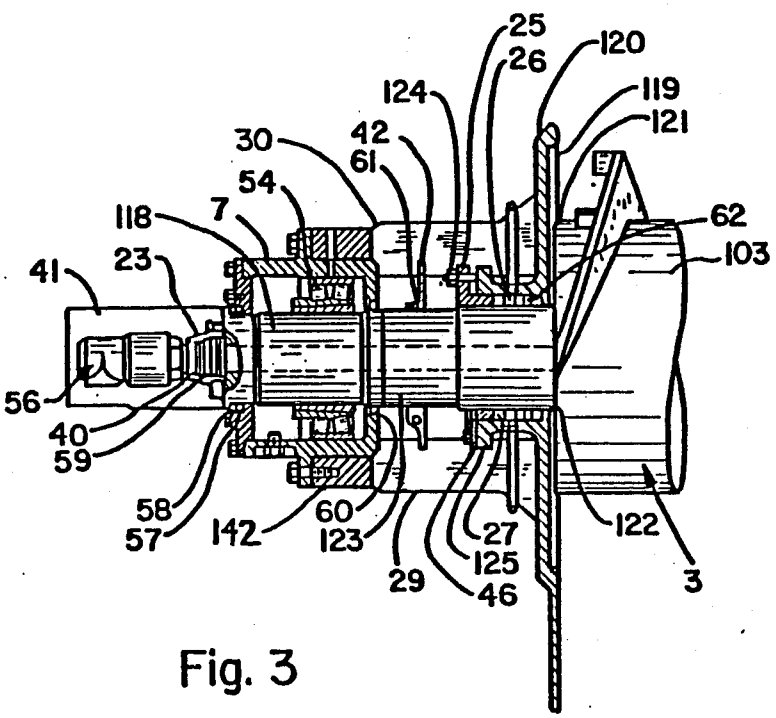
FIG. 3 is a detailed view of the rotary fluid joint for supplying fluid through the shaft to the washing section.

FIG. 3 shows an enlarged detailed view of the mounting of the screw shaft and rotary joint 56 near the inlet section 2*a*. The screw 3, having the outer diameter indicated at 103, has a trailing edge 121 which terminates adjacent to portion 119 of the housing inlet 2*a*. An aperture 122 is provided in the wall portion 119, so that the screw shaft extension 123 penetrates wall 119 and extends exteriorly of the inlet section 2*c*. The extension shaft 123 preferably has a plurality of cylindrical portions of differing diameter. The extension portion 123 as well as the screw portion 103 includes a central channel 118 through which wash fluid is delivered to the radial holes 124 in the shaft portion situated within the washing section 2*c* (FIG. 2). The terminus of the shaft extension 123 includes a rotary joint 56, such as Aeroquip Type E-75, which is radially engaged to a rotary joint holder 23. The holder 23 is in turn connected to the shaft 123 and includes a 0-ring seal 59 between the holder 23 and the injection pipe portion 40 of the rotary joint 56. A rotary joint cover 41 may optionally be provided. A radial seal 57 is provided between the shaft 123 and a seal sleeve 58, which is in turn threadably secured to the inlet side bearing 7. The bearing 7 encloses a spherical roller set 54 which is in contact with the shaft 123. A cover ring 142 is secured to both the housing bearing 7 and to the upper and lower covers 29, 30 which extend substantially cylindrically between the bearing housing 7 and the wall 119. Preferably, a special mounting fitting 120 is welded to the wall 119 and has a neck portion 125 extending outwardly from the wall 119, within the covers 29 and 30. A shaft flinger 42 is interposed between the covers 29, 30 and shaft 123. At this and at a plurality of other axially spaced locations, shaft seal means, such as 0-rings 61, radial seals 60, lantern packing ring 26, packing rings 62, and lantern seal rings 27 are provided and, where appropriate, a packing follower 25 for tightening the connection of the packing against a seat in the fitting 120. It may be appreciated that this arrangement between the screw 103 and the housing portion at the inlet section 2*a*, accomplishes all the necessary functions, which include supplying wash fluid axially through the rotating screw 3, sealing the rotating screw against leakage through the wall 119, and supporting the screw so that the pulp slurry can accumulate and begin its journey along the screw, within the inlet section 2*a*.

Figure 4:
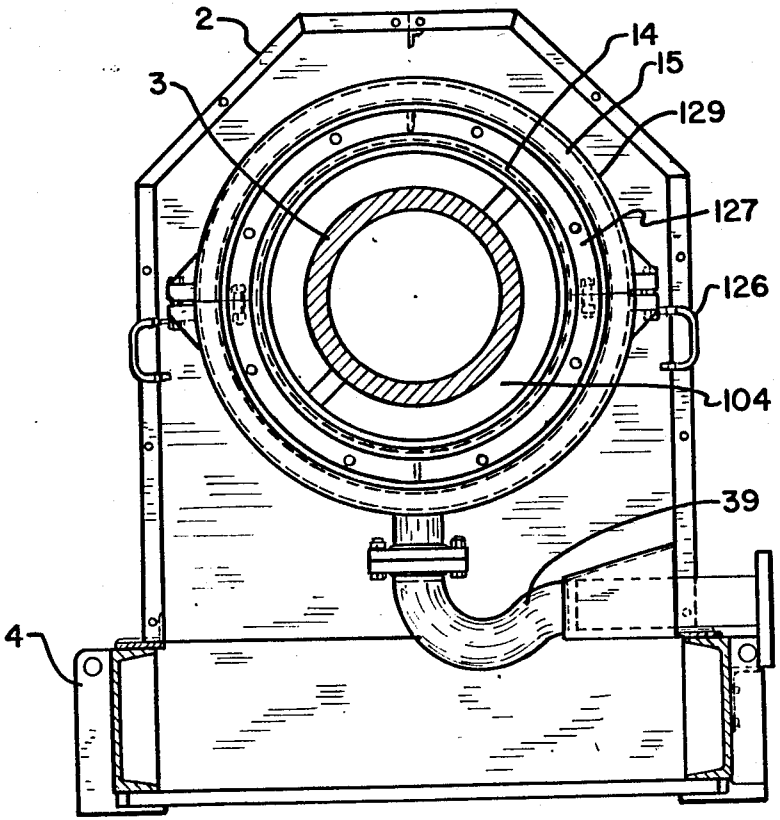
FIG. 4 is a section view taken along line 4—4 of FIG. 2.

FIG. 4 is a cross-section taken through line 4—4 of FIG. 2, showing the preferred support for the pressurized jacket 15, and related components. The wash jacket 15 is supported by the flanges of the wash screen 14. "O" rings between the jacket and screen seal against loss of wash water. Item 126 is a handle used for lifting the screen covers off the press. The wash jacket 15 has an imperforate outer wall 129 and inner wall 14 which is perforated. A similar flange is provided at the downstream end of the jacket as shown in FIG. 2. The pressure screw 3 penetrates coaxially through the annular jacket 15, and the screw flights change from helical as shown at 104 to interrupted 111 after the screw extends into the wash chamber 110, (FIG. 2). At the lower part of the jacket 15, substantially perpendicular to the longitudinal axis, injection piping 39 is in fluid communication with the jacket 15 for supplying wash fluid under pressure to the annular space between the jacket inner and outer walls 14, 129. The pressurized wash liquid is thus injected into the wash chamber 110 in a radially inwardly direction.

Figure 5:
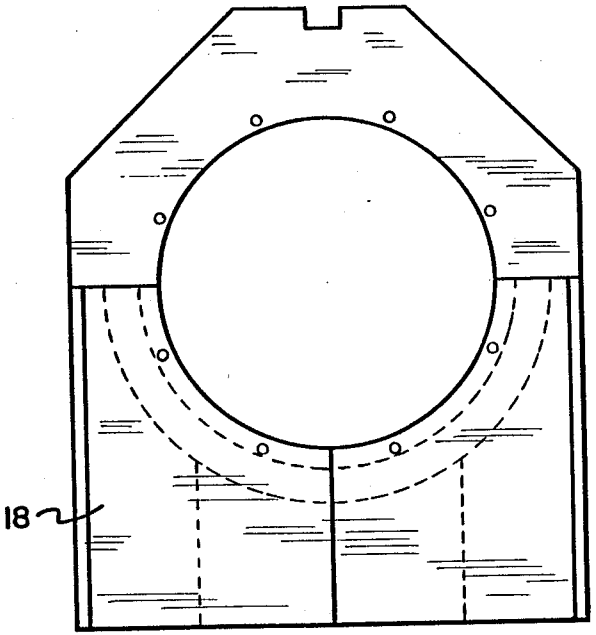
FIG. 5 is a section detailed view of the screen support structure of the mixing section.

As may be understood with joint reference to FIGS. 2, 4 and 5, a vertical screen support and divider 18 separates in the washing and repressing sections 2*c*, 2*d* from the pressing section 2*b*. The screen support 18 is external to the screens 13, 14 and the wash section. The flanged connection between screen 13 and wash screen 14 rests on the screen support. This controls deflection of the screens and the clearance between the screw and screens. The screen support also separates the base into two sections, preventing mixing of the pressates. This allows countercurrent washing or separate chemical recovery. Countercurrent washing is achieved by collecting the pressate from the repressing section 2*d* and using it to dilute the stock prior to pumping it to the press inlet 5.

Figure 7:
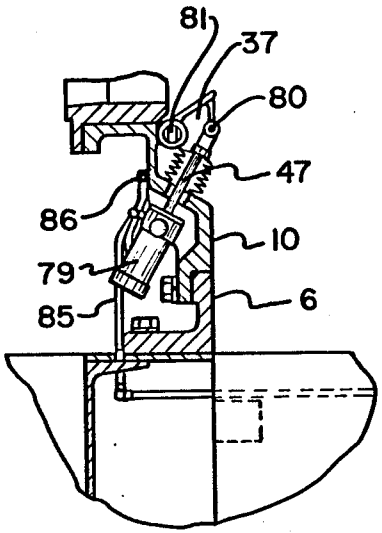
FIG. 7 is a detailed view of the back pressure flaps associated with the discharged area of the screw press.
Figure 6:
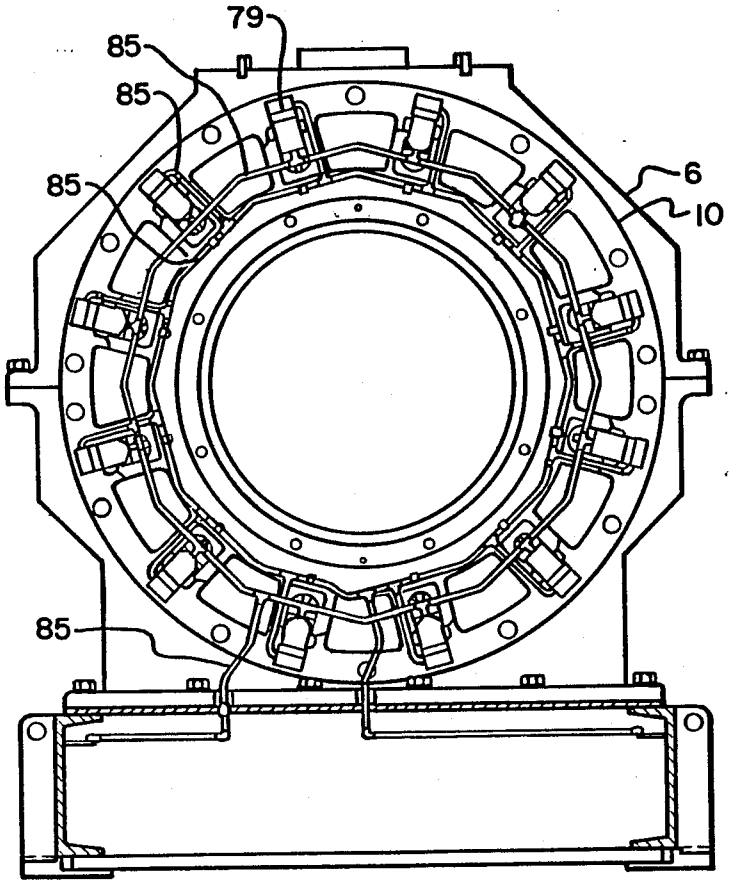
FIG. 6 is a cross-section view taken along line 6—6 of FIG. 2.
Figure 8:
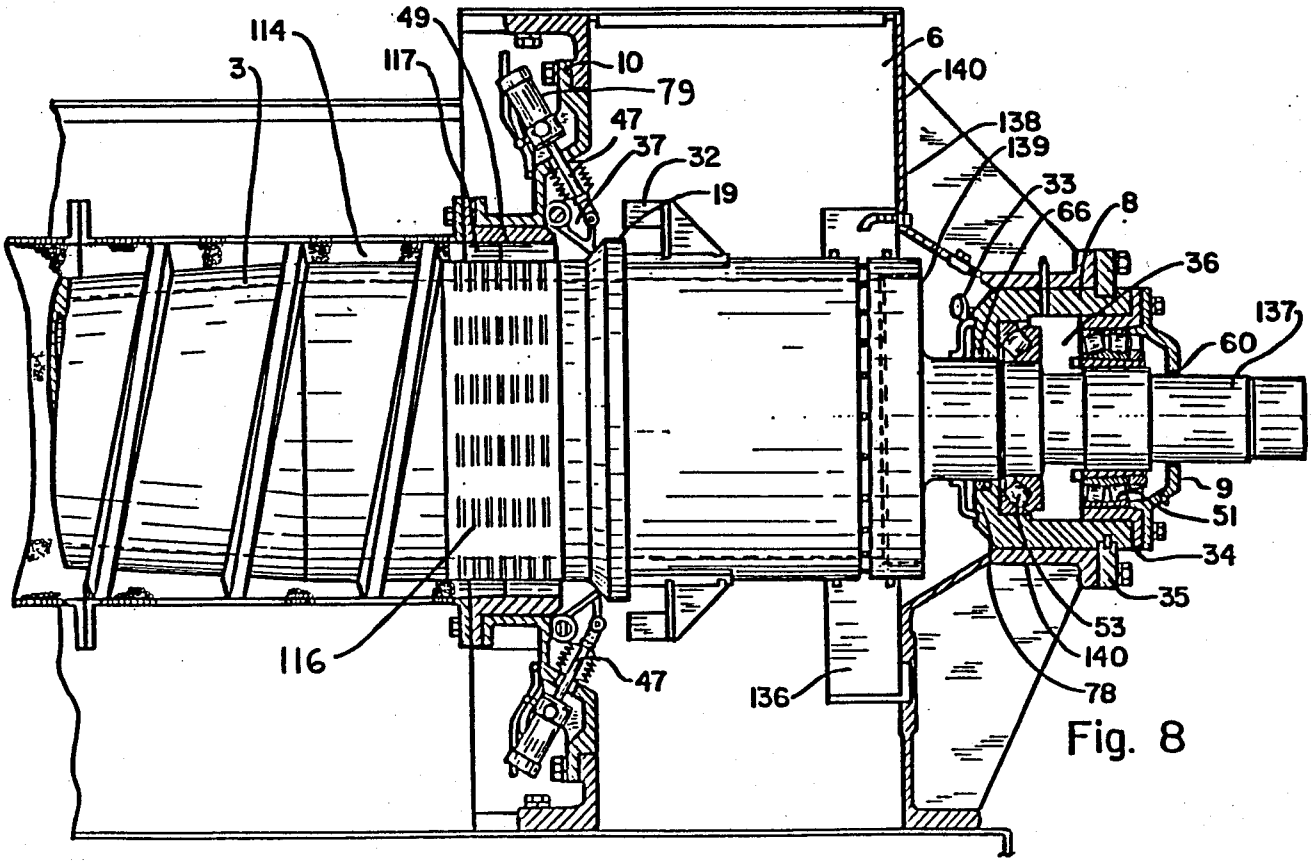
FIG. 8 is a detailed view of the discharge region of the press.

FIGS. 6, 7 and 8 show in greater detail, the preferred arrangement between the screw 3 and structure in the discharge section 2*e*. As the repressed pulp passes through annulus 114, it encounters another restricted annulus 117 formed between a final screen restrictor or deflector ring 49 and an extended portion of the screw 116, constituting a perforated, final extraction screen. The screen deflector 49 is mounted to the discharge section housing 6, and a plurality of discharge fingers 37 are arranged in an annulus to control the back pressure and thus improve the consistency of the pulp that emerges from the processing within the housing. The screw has a stock restrictor ring 19 projecting annularly with an oblique surface substantially facing the discharge fingers 37. The screw 3 further includes a plurality of spaced breaker bars 32 immediately downstream of the ring 19, to prevent unwanted buildup of the pulp in the vicinity of the fingers 37.

The fingers are part of a finger assembly which is mounted on substantially circular cylinder mounting plate 10, rigidly secured to the housing 6 and preferably to the screen deflector 49. A plurality of air cylinder shafts 47 pass through annularly-spaced apart holes in the plate 10, and project toward the stock restrictor ring 19. An air cylinder 79 provides a preload on the shafts 47 and, through clevis joints 80 and rotatable finger shafts 81, the finger 37 is biased toward the ring 19, a predetermined or controllable amount. Nylon tubing 85 and associated clamps and fittings 86, provide the required air pressure to the cylinders 79.

The combined back pressure effects of the fingers 37 and the stock deflector ring 49, cause at least some of the residual liquid in the repressed pulp that has passed through annulus 114, to be "squeezed" through the apertures in final screen 116, and enter the interior of the screw 3. This fluid is drained through an auxiliary drain 136 and disposed of or handled in any convenient manner. The cleaned, relatively dry pulp accumulates within the housing 6 of the discharge section 2*e*, and is likewise drawn off for further processing in the manufacture of paper, in the conventional manner.

The driven end of the pressure screw has an extension portion 137 that has several diameters, analogous to the extension shaft 123 shown in FIG. 3. The outermost portion of shaft 137 is adapted to be driven by a motor in a conventional manner. The end wall 138 of the discharge section 2e has an opening through which the screw penetrates. The edge 139 of screw 3 in approximate vertical alignment with, or slightly exterior of end wall 138. Bracket 140 is secured to the end wall 138 and has a cylindrical portion projecting projects coaxially with the shaft 137. The bracket 140 supports the bearing assembly for the driven end of the screw shaft 137. Preferably, a bearing housing key 35 is connected between the bracket 140 and the bearing housing 8. At its inner end, the housing 8 supports a labyrinth seal 33 against the shaft, and a radial seal 66. At its exterior end, the housing 8 supports a bearing holder 34 and a cover member 9, the latter preferably including a radial seal 60 between it and the shaft. Within the confines of the bearing housing 8 and bearing holder 34, are situated spherical roller bearings 51, a thrust bearing support 36, and thrust bearings 53, each of these components engaging a different diameter portion of the shaft 137. A helical spring 78 is interposed between the radially extending portion of the discharge bearing housing 8, and the thrust bearing 53.

It can be appreciated that the arrangement of the discharge section 2e as described herein, is well suited to perform the functions of maximizing the extraction of liquid from the repressed pulp, draining off and isolating the liquid, and providing a sealed bearing support for the driven end of the screw shaft.

It should also be understood that reference herein to pressing, washing, repressing, and final pressing "sections" does not necessarily require that such sections be separate components that are attached together. Rather, the different sections refer to different functions. The structures that perform such functions may in some instances be integrally connected, or be formed from different portions of a unitary part.

We claim:

1. A displacement press for washing a pulp slurry to remove process liquors comprising:

an elongated housing having a slurry inlet port at one end and a pulp discharge port at the other end;

a pressing section within the housing in fluid communication with the inlet port, and including first means, for extracting liquor from the slurry by passing the slurry through a first compression restriction to produce a pressed pulp;

a washing section within the housing immediately downstream of and in fluid communication with the first compression restriction, said washing section having coaxial inner and outer walls defining an elongated washing chamber for decompressing and washing the pressed pulp, said washing section including, means for injecting washing liquid into the washing chamber through said inner wall, means projecting from at least one of said walls into the washing chamber, for mechanically agitating the decompressed pulp and wash liquid to produce a mixture, a wash jacket including a perforated cylindrical portion concentrically disposed within an imperforate cylindrical portion which define an annular space therebetween, said perforated cylindrical portion forming said washing section outer wall, means for supplying washing liquid into the wash jacket for injection throughout the washing chamber through said outer wall formed by said perforated cylinder, means for conveying the mixture of decompressed pulp and washing liquid from the washing chamber longitudinally through the washing section; and a repressing section within the housing in fluid communication with the washing section for receiving said conveyed mixture, said repressing section including, second means, for extracting the washing liquid from the mixture by passing the mixture through a second compression restriction to produce a repressed pulp, and means for conveying the repressed pulp to said discharge port.

2. The washing press of claim 1, including a rotatable shaft passing longitudinally through said housing, wherein the inner wall of said washing chamber is formed by a portion of said shaft.

3. The washing press of claim 1, further including a final pressing section between the repressing section and the discharge port, the final pressing section having a perforated, substantially cylindrical inner surface and a tapered compression ring defining an outer surface spaced from the inner surface, whereby at least some of the washing liquid remaining in the repressed pulp, that emerges from the repressing section, is forced through said perforations before the repressed pulp is discharged from the housing.

4. The washing press of claim 1, wherein the pressing, washing, and repressing sections include a rotatable shaft passing longitudinally through said housing, said shaft having an outer surface including, a first tapered portion of increasing diameter in the downstream direction through the pressing section, a substantially cylindrical intermediate portion substantially longitudinally coextensive with said washing section and defining said washing chamber inner wall, and a second tapered portion of increasing diameter in the downstream direction through the repressing section.

5. The washing press of claim 4, wherein the means for injecting washing liquid through said outer wall includes a washing liquid supply line discharging into said wash jacket for injecting washing liquid radially inwardly into the wash chamber.

6. The washing press of claim 4, wherein the means for injecting washing liquid through said inner wall includes a washing liquid first supply line passing longitudinally through the shaft first portion and terminating in a plurality of radial holes in the shaft intermediate portion, said holes being adapted for injecting washing liquid radially outwardly from the shaft into the wash chamber.

7. The washing press of claim 6, wherein the means for injecting washing liquid through said outer wall includes a wash liquid second supply line discharging into said washing jacket for injecting washing water radially inwardly into the washing chamber.

8. The washing press of claim 7, further including a final pressing section between the repressing section and the discharge port, the final pressing section having a perforated, substantially cylindrical inner surface and a tapered compression ring defining an outer surface spaced from the inner surface, whereby at least some of the washing liquid remaining in the repressed pulp, that emerges from the repressing section, is forced through said perforations before the repressed pulp is discharged from the housing.

9. The washing press of claim 4, including a base supporting the housing and collecting pressate, and divider means between the pressing section and the washing section, for isolating the pressate of the pressing section from the pressate of the repressing section.

10. The washing press of claim 1, including a ba supporting the housing and collecting pressate, and divider means between the pressing section and the washing section, for isolating the pressate of the pressing section form the pressate of the repressing section.

11. A displacement washing press comprising:

a horizontally extending base having first and second ends; a housing including, an inlet section connected to the first end of the base, and having an inlet port oriented transversely to the base for receiving a pulp slurry to be pressed, a horizontal pressing section connected to the inlet section and the base and including a central pressing bore, a horizontal washing section connected to the pressing section and to the base, and including a central washing bore and means for injecting washing liquid into the washing bore, said means for injecting including a washing jacket having a perforated wall defining said central washing bore, and an imperforate wall surrounding said perforated wall, a horizontal repressing section connected to the washing section housing and to the base and including a repressing bore, and a discharge section connected to the repressing section and to the base;

a pressure screw oriented parallel to the base and passing through the inlet section, the pressing, washing, and repressing bores, and the discharge section, said screw having, a first screw portion cooperating with the pressing section bore to form a first compressive restriction annulus for pressing the liquid from the pulp slurry and including means for conveying the pressed pulp to the wash section, a second screw portion cooperating with the wash section bore to define a wash chamber expansion annulus that is everywhere less restrictive than said first compressive restriction annulus, for decompressing and mixing the pressed pulp and the injected wash liquid, and including means for conveying the mixed pulp in the wash chamber to the repressing section, a third screw portion cooperating with the repressing section bore for repressing the washed pulp and conveying the repressed washed pulp to the discharge section, and a fourth shaft portion cooperating with the discharge section for extracting additional liquid from the repressed pulp through perforations in said shaft fourth portion.

12. The washing press of claim 11, wherein the discharge section includes an annular deflection ring defining a restricted annulus, and means annularly disposed immediately downstream of the deflection ring for selectively varying the back pressure of the repressed pulp in the discharge section, and the fourth shaft portion cooperates with the deflection ring to extract said additional liquid.

13. The washing press of claim 12, wherein the perforations in the shaft are radially opposite the deflection ring, and said shaft fourth portion further includes a restriction ring located in opposition to and cooperating with the means for varying the back pressure.

14. A displacement washing press comprising:

a housing including, a horizontally extending base;

an inlet section at one end of the base, for receiving a pulp slurry to be pressed, a pressing section connected to the inlet section and to the base, a washing section connected to the pressing section and to the base, and including jacket means having an annular space defined by an imperforate outer wall and a perforate inner wall for delivering washing liquid to the interior of the washing section, a repressing section connected to the washing section and the base, a discharge section connected to the repressing section and to the base; and a pressure screw oriented parallel to the base and passing through the inlet, pressing, washing, repressing and discharge sections, said screw having, a first end passing outwardly through the inlet section and forming a projecting shaft, a tapered portion in the pressing section, a substantially cylindrical intermediate portion in the washing section which with said jacket means defines an elongated washing chamber in the interior of the washing section for decompressing and mixing the washing liquid and pressed pulp, a tapered portion in the repressing section, a second end in the form of a shaft extending outwardly through the discharge section, a channel passing from the first end of the screw to the cylindrical portion in the washing section, and means in the cylindrical portion in the washing section, and fluidly connected to the channel, for receiving washing liquid from the screw first end and discharging the liquid radially outwardly from the screw in the washing section as the screw rotates.

15. The washing press of claim 14, wherein the jacket means includes an imperforate outer wall and a radially inner, substantially cylindrical wash screen in part defining said washing chamber.

* * * * *